US011310613B2

(12) United States Patent
Wu et al.

(10) Patent No.: US 11,310,613 B2
(45) Date of Patent: Apr. 19, 2022

(54) AUDIO CALIBRATION METHOD AND DEVICE

(71) Applicant: MERRY ELECTRONICS(SUZHOU) CO., LTD., Suzhou (CN)

(72) Inventors: Hui Wu, Suzhou (CN); Chunyan Hu, Suzhou (CN); Tianliang Zhang, Suzhou (CN)

(73) Assignee: MERRY ELECTRONICS(SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 17/094,039

(22) Filed: Nov. 10, 2020

(65) Prior Publication Data

US 2021/0385595 A1 Dec. 9, 2021

(30) Foreign Application Priority Data

Jun. 9, 2020 (CN) ..... 202010518969.3

(51) Int. Cl.
*H04R 29/00* (2006.01)
*H04R 1/20* (2006.01)

(52) U.S. Cl.
CPC ..... *H04R 29/001* (2013.01); *H04R 1/20* (2013.01)

(58) Field of Classification Search
CPC ..... H04R 29/001; H04R 1/20; H04R 1/1008; H04R 1/10
See application file for complete search history.

(56) References Cited

U.S. PATENT DOCUMENTS 10,764,699 B1 * 9/2020 Rule ..... G10K 11/17885
11,026,034 B2 * 6/2021 Kannan ..... H04R 3/04
(Continued)

FOREIGN PATENT DOCUMENTS

CN 103987000 A 8/2014
CN 106211013 A 12/2016
(Continued)

OTHER PUBLICATIONS

Chinese Office Action and Search Report for Chinese Application No. 202010518969.3, dated Jan. 22, 2021, with English translation.

*Primary Examiner* — Jason R Kurr
(74) *Attorney, Agent, or Firm* — Birch, Stewart, Kolasch & Birch, LLP

(57) ABSTRACT

Provided are an audio calibration method and device. The method includes: transmitting an audio calibration signal to a first loudspeaker and a second loudspeaker such that the first loudspeaker and the second loudspeaker generate sound signals; determining first loudspeaker sound information through a sound signal generated by the first loudspeaker and acquired by a first microphone and a sound signal generated by the first loudspeaker and acquired by the second microphone; determining second loudspeaker sound information through a sound signal generated by the second loudspeaker and acquired by the first microphone and a sound signal generated by the second loudspeaker and acquired by the second microphone; and determining a calibration parameter of the first loudspeaker or a calibration parameter of the second loudspeaker according to the first loudspeaker sound information and the second loudspeaker sound information.

12 Claims, 3 Drawing Sheets

(56) References Cited

U.S. PATENT DOCUMENTS

| | | | | |
|---|---|---|---|---|
| 2011/0116643 | A1* | 5/2011 | Tiscareno | H04R 5/033 381/58 |
| 2016/0134970 | A1 | 5/2016 | Kraemer | |
| 2017/0245045 | A1* | 8/2017 | Horbach | H04R 3/04 |
| 2019/0238968 | A1* | 8/2019 | Hajati | H04R 1/1008 |

FOREIGN PATENT DOCUMENTS

| | | | |
|---|---|---|---|
| CN | 108810717 | A | 11/2018 |
| CN | 110753296 | A | 2/2020 |

* cited by examiner

AUDIO CALIBRATION METHOD AND DEVICE

CROSS-REFERENCE TO RELATED APPLICATION(S)

This application claims priority to a Chinese patent application No. 202010518969.3 filed on Jun. 9, 2020, disclosure of which is incorporated herein by reference in its entirety.

TECHNICAL FIELD

Embodiments of the present disclosure relate to the technical field of an intelligent apparatus, in particular, to an audio calibration method and device.

BACKGROUND

With the improvement of living standards and the rapid development of the earphone technology, more and more people use a stereo headphone, especially music lovers and enthusiasts.

However, sometimes after the earphone is used for a period of time, sounds may be different between a left ear and a right ear, i.e., the sound heard by the left ear is inconsistent with the sound heard by the right ear. The condition is manifested as the sound leaning on the left ear or the sound leaning on the right ear, thus seriously affecting a user's listening experience. Currently, for this kind of condition, it is usually to exchange the old earphone for a new one or repair the original earphone, which is not only time-consuming and laborious, but also delays using of a user.

SUMMARY

The present disclosure provides an audio calibration method and an audio calibration device, which can automatically calibrate an earphone for a user, thereby improving a user experience.

An embodiment of the present disclosure provides an audio calibration method. The method is executed by a processor built in a headphone, which includes a first loudspeaker, a second loudspeaker, a first microphone and a second microphone. The method includes steps described below.

An audio calibration signal is transmitted to the first loudspeaker and the second loudspeaker such that the first loudspeaker and the second loudspeaker generate sound signals, where the first loudspeaker and the second loudspeaker are disposed opposite to each other.

First loudspeaker sound information is determined through a sound signal generated by the first loudspeaker and acquired by the first microphone and a sound signal generated by the first loudspeaker and acquired by the second microphone, where the first microphone and the second microphone are disposed opposite to each other.

Second loudspeaker sound information is determined through a sound signal generated by the second loudspeaker and acquired by the first microphone and a sound signal generated by the second loudspeaker and acquired by the second microphone.

A calibration parameter of the first loudspeaker or a calibration parameter of the second loudspeaker is determined according to the first loudspeaker sound information and the second loudspeaker sound information.

An embodiment of the present disclosure further provides an audio calibration device. The audio calibration device is applied to calibrate consistency of a first loudspeaker and a second loudspeaker in a headphone by using any one of the methods in the embodiment of the present disclosure. In response to calibrating the first loudspeaker or the second loudspeaker in the headphone, the device is further provided with a cylindrical cavity. A circular bottom surface of the cylindrical cavity is fitted with each earmuff of the headphone, an inner part of the cylindrical cavity is empty, and a material of an inner surface of the cylindrical cavity is sound-absorbing cotton.

In the present disclosure, the audio calibration signal is transmitted to the first loudspeaker and the second loudspeaker in the headphone such that the first loudspeaker and the second loudspeaker generate the sound signals separately; the sound signal of the first loudspeaker is acquired through the first microphone and the second microphone separately such that the sound information of the first loudspeaker is determined; the sound signal of the second loudspeaker is acquired through the first microphone and the second microphone separately such that the sound information of the second loudspeaker is determined; and finally the calibration parameter of the first loudspeaker or the calibration parameter of the second loudspeaker is determined according to the sound information of the first loudspeaker and the sound information of the second loudspeaker.

In the technical solution of the present disclosure, in a case where sounds between the left and right ears of the earphone are inconsistent, an automatic calibration of the earphone is achieved without returning the earphone to a factory for maintenance, thereby improving the user experience.

DETAILED DESCRIPTION

Figure 1A:
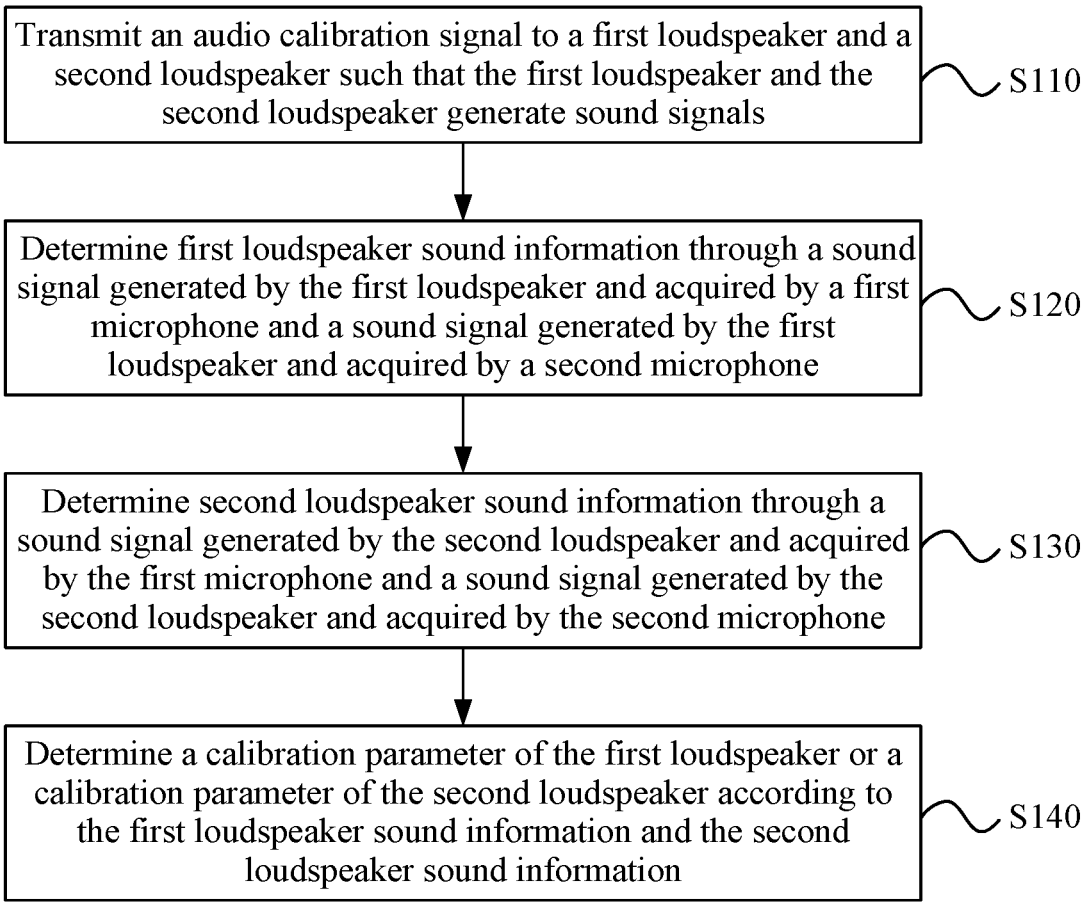
FIG. 1A is a flowchart of an audio calibration method according to embodiment one of the present disclosure.

The present disclosure will be further described in detail below with reference to the drawings and embodiments. It should be understood that the specific embodiments described herein are merely used for explaining the present disclosure, but not to limit the present disclosure. In addition, it should be noted that, for ease of description, the drawings only show a part, not all of the structures related to the present disclosure.

Before the exemplary embodiments are discussed in more detail, it should be mentioned that part of the exemplary embodiments are described as processing or methods depicted in flowcharts. Although the flowcharts describe the steps as a sequential processing, many of the steps may be implemented concurrently, coincidently or simultaneously. In addition, the sequence of the steps may be rearranged. The processing may be terminated when the operations are completed, but may further have additional steps not included in the drawings. The processing may correspond to a method, a function, a procedure, a subroutine, a subprogram or the like.

Embodiment One

FIG. 1A is a flowchart of an audio calibration method according to embodiment one of the present disclosure. The present embodiment may be applied to a condition that an automatic calibration of an earphone is achieved in a case where sounds between the left and right ears of the earphone are inconsistent. The method may be executed by an audio calibration device, specifically, the method is executed by a processor built in a headphone. The headphone includes a first loudspeaker, a second loudspeaker, a first microphone and a second microphone. The first loudspeaker and the second loudspeaker are disposed opposite to each other, and the first microphone and the second microphone are disposed opposite to each other. The device may be implemented in a software and/or hardware mode and may be integrated into an electronic device. The method includes steps described below.

In S110, an audio calibration signal is transmitted to the first loudspeaker and the second loudspeaker such that the first loudspeaker and the second loudspeaker generate sound signals.

In this embodiment, the audio calibration signal refers to a sound signal that can be used as a reference. The audio calibration signal may be transmitted after detecting that a user triggers an audio signal calibration key disposed outside the headphone, or may be transmitted after detecting that the user has long pressed a volume key outside the headphone for a preset period of time If the audio calibration signal is transmitted by the user long pressing the volume key outside the headphone, the user may preset a duration of long pressing the volume key, for example, the duration may be 5S.

In this embodiment, when the audio calibration signal is transmitted to the first loudspeaker, the first loudspeaker generates a corresponding sound signal, and when the audio calibration signal is transmitted to the second loudspeaker, the second loudspeaker generates a corresponding sound signal. Sound signals are generated asynchronously by the first loudspeaker and the second loudspeaker. In this embodiment, it is not limited whether the first loudspeaker generates the sound signal first or the second loudspeaker generates the sound signal first.

In S120, first loudspeaker sound information is determined through a sound signal generated by the first loudspeaker and acquired by the first microphone and a sound signal generated by the first loudspeaker and acquired by the second microphone.

In this embodiment, the first microphone and the second microphone respectively acquire the sound signal generated by the first loudspeaker, and the sound signal acquired by the first microphone and the sound signal acquired by the second microphone are calculated to obtain sound information of the first loudspeaker. Specifically, the sound signal generated by the first loudspeaker and acquired by the first microphone is recorded as FB Mic_L_FR1, the sound signal generated by the first loudspeaker and acquired by the second microphone is recorded as FB Mic_R_FR1, the sound information of the first loudspeaker is recorded as SPK_L, and then SPK_L is calculated according to FB Mic_L_FR1 and FB Mic_R_FR1.

Optionally, the first loudspeaker sound information is an average value of the sound signal generated by the first loudspeaker and acquired by the first microphone and the sound signal generated by the first loudspeaker and acquired by the second microphone.

Specifically, it may be embodied by the following formula: SPK_L=(FB Mic_L_FR1+FB Mic_R_FR1)/2. It should be understood by those skilled in the art that the above-mentioned calculation mode is for illustrative purposes only and is not intend to be a limitation of uniqueness.

In S130, second loudspeaker sound information is determined through a sound signal generated by the second loudspeaker and acquired by the first microphone and a sound signal generated by the second loudspeaker and acquired by the second microphone.

In this embodiment, the first microphone and the second microphone respectively acquire the sound signal generated by the second loudspeaker, and the sound signal acquired by the first microphone and the sound signal acquired by the second microphone are calculated to obtain sound information of the second loudspeaker. Specifically, the sound signal generated by the second loudspeaker and acquired by the first microphone is recorded as FB Mic_L_FR2, the sound signal generated by the second loudspeaker and acquired by the second microphone is recorded as FB Mic_R_FR2, the sound information of the second loudspeaker is recorded as SPK_R, and then SPK_R is calculated according to FB Mic_L_FR2 and FB Mic_R_FR2.

Optionally, the second loudspeaker sound information is an average value of the sound signal generated by the second loudspeaker and acquired by the first microphone and the sound signal generated by the second loudspeaker and acquired by the second microphone.

Figure 1B:
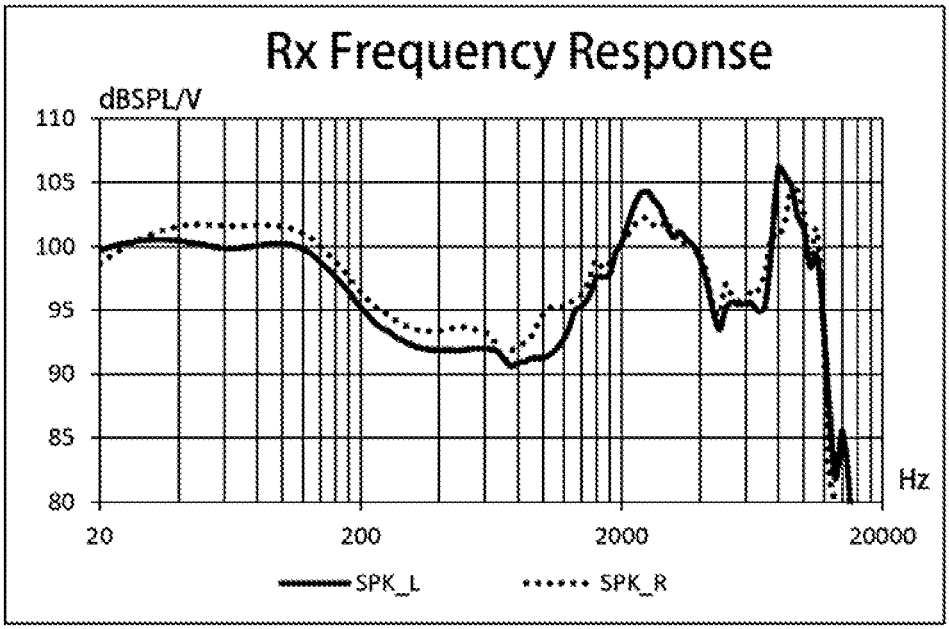
FIG. 1B is a diagram illustrating an SPK_L curve and an SPK_R curve according to embodiment one of the present disclosure.

Specifically, it may be embodied by the following formula: SPK_R=(FB Mic_L_FR2+FB Mic_R_FR2)/2. Specifically, FIG. 1B shows a diagram illustrating SPK_L curve and an SPK_R curve.

In S140, a calibration parameter of the first loudspeaker or a calibration parameter of the second loudspeaker is determined according to the first loudspeaker sound information and the second loudspeaker sound information.

In this embodiment, optionally, the step of determining the calibration parameter of the first loudspeaker or the calibration parameter of the second loudspeaker according to the first loudspeaker sound information and the second loudspeaker sound information includes steps described below.

If a difference value between a sensitivity of the first loudspeaker sound information and a sensitivity of the second loudspeaker sound information is within a preset range, a difference value between the first loudspeaker sound information and the second loudspeaker sound information is calculated.

The difference value between the first loudspeaker sound information and the second loudspeaker sound information is taken as the calibration parameter of the first loudspeaker or the calibration parameter of the second loudspeaker.

In this embodiment, the sensitivity refers to an amplitude of the sound information corresponding to a frequency of 1 KHZ, and a value of the sensitivity is a positive value. In this embodiment, the sensitivity of the first loudspeaker sound information is recorded as Sen_L, the sensitivity of the second loudspeaker sound information is recorded as Sen_R, the difference value between the sensitivity of the first loudspeaker sound information and the sensitivity of the second loudspeaker sound information is recorded as D, and then D=Sen_L−Sen_R.

If an absolute value of D is within a preset range, it means that a problem that sounds between the left and right ears of the headphone to be calibrated are inconsistent can be solved through automatic calibration of the headphone. If the absolute value of D is not within the preset range, it means that the problem that the sounds between the left and right ears of the headphone to be calibrated are inconsistent cannot be solved through the automatic calibration of the headphone and the headphone needs to be returned to a factory for maintenance. The preset range may be 3-6.

Figure 1C:
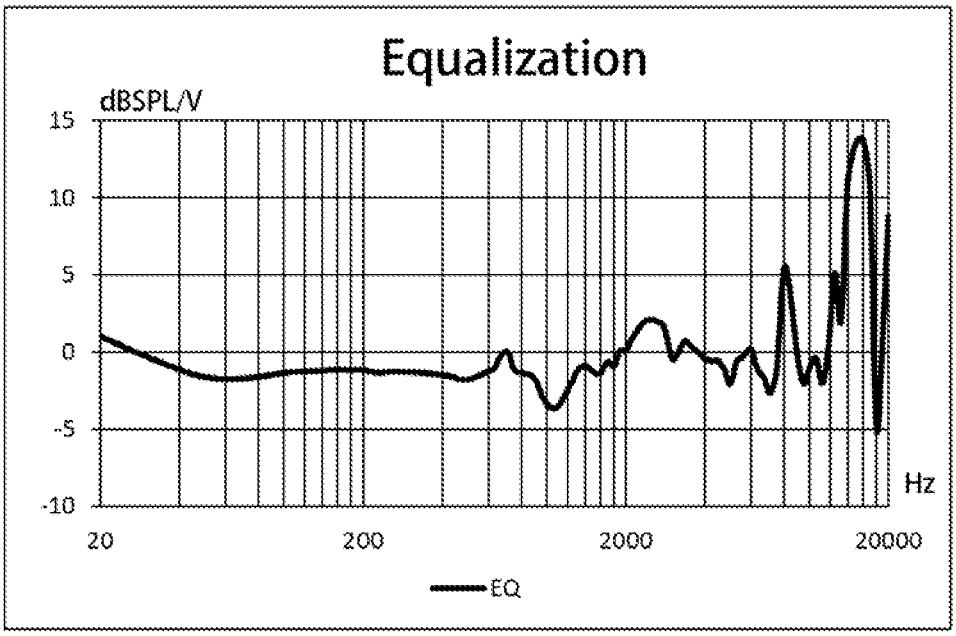
FIG. 1C is a diagram illustrating an EQ curve according to embodiment one of the present disclosure.

If the absolute value of D is within the preset range, the difference value between the first loudspeaker sound information and the second loudspeaker sound information is calculated, and specifically, the difference value can be calculated by the following formula: EQ=SPK_L−SPK_R. Specifically, FIG. 1C shows a diagram of an equalization curve (EQ). A value of EQ serves as the calibration parameter for adjusting the first loudspeaker or the calibration parameter for adjusting the second loudspeaker. If the absolute value of D is not within the preset range, processing is stopped and the calibration parameter of the first loudspeaker or the calibration parameter of the second loudspeaker is not adjusted.

Optionally, the step of taking the difference value between the first loudspeaker sound information and the second loudspeaker sound information as the calibration parameter of the first loudspeaker or the calibration parameter of the second loudspeaker includes steps described below.

If the difference value between the sensitivity of the first loudspeaker sound information and the sensitivity of the second loudspeaker sound information is greater than zero, the difference value between the first loudspeaker sound information and the second loudspeaker sound information is taken as the calibration parameter of the first loudspeaker.

If the difference value between the sensitivity of the first loudspeaker sound information and the sensitivity of the second loudspeaker sound information is less than zero, the difference value between the first loudspeaker sound information and the second loudspeaker sound information is taken as the calibration parameter of the second loudspeaker.

In this embodiment, if the absolute value of D is within the preset range and the value of D is greater than zero, the value of EQ is taken as the calibration parameter of the first loudspeaker. If the absolute value of D is within the preset range and the value of D is less than zero, the value of EQ is taken as the calibration parameter of the second loudspeaker.

Optionally, a specific adjustment process is described below. If the difference value between the sensitivity of the first loudspeaker sound information and the sensitivity of the second loudspeaker sound information is greater than zero, the difference value between the first loudspeaker sound information and the second loudspeaker sound information is inversely converted to a negative value and the negative value is superimposed on the first loudspeaker sound information.

In this embodiment, if the absolute value of D is within the preset range and the value of D is greater than zero, the value of EQ is changed to an opposite number as the calibration parameter of the first loudspeaker.

Optionally, if the difference value between the sensitivity of the first loudspeaker sound information and the sensitivity of the second loudspeaker sound information is less than zero, the difference value between the first loudspeaker sound information and the second loudspeaker sound information is superimposed on the second loudspeaker.

In this embodiment, if the absolute value of D is within the preset range and the value of D is less than zero, the value of EQ is taken as the calibration parameter of the second loudspeaker without any processing.

In the present disclosure, the audio calibration signal is transmitted to the first loudspeaker and the second loudspeaker in the headphone such that the first loudspeaker and the second loudspeaker generate the sound signals separately; the sound signal of the first loudspeaker is acquired through the first microphone and the second microphone separately such that the sound information of the first loudspeaker is determined; the sound signal of the second loudspeaker is acquired through the first microphone and the second microphone separately such that the sound information of the second loudspeaker is determined; and finally the calibration parameter of the first loudspeaker or the calibration parameter of the second loudspeaker is determined according to the sound information of the first loudspeaker and the sound information of the second loudspeaker. In the technical solution of the present disclosure, in a case where the sounds between the left and right ears of the earphone are inconsistent, the automatic calibration of the earphone is achieved without returning to the factory for maintenance, thereby improving a user experience.

Embodiment Two

Figure 2:
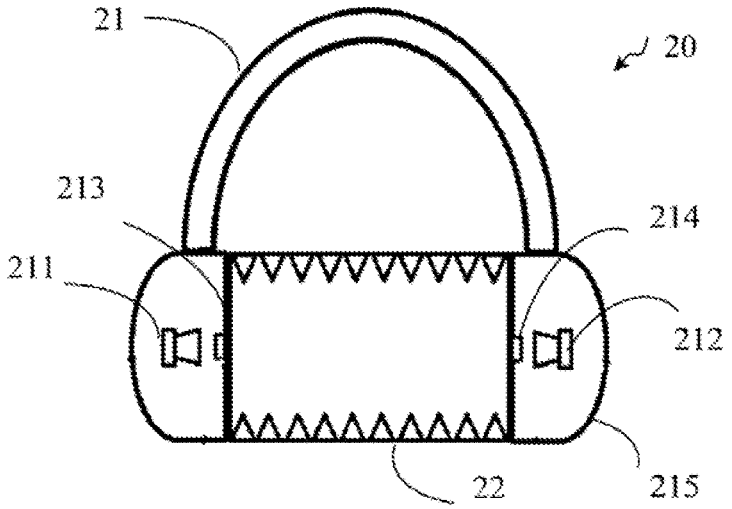
FIG. 2 is a structural diagram of an audio calibration device according to embodiment two of the present disclosure.

FIG. 2 is a structural diagram of an audio calibration device according to embodiment two of the present disclosure. The audio calibration device provided by the embodiment of the present disclosure can execute the audio calibration method provided by any embodiment of the present disclosure, and has effects corresponding to the execution methods. As shown in FIG. 2, the device includes a headphone.

The audio calibration device 20 includes the headphone 21, and the headphone 21 includes a first loudspeaker 211, a second loudspeaker 212, a first microphone 213 and a second microphone 214. The first loudspeaker 211 and the second loudspeaker 212 are disposed opposite to each other, and the first microphone 213 and the second microphone 214 are disposed opposite to each other.

When the first loudspeaker 211 or the second loudspeaker 212 in the headphone 21 is calibrated, the device is further configured with a cylindrical cavity 22, a circular bottom surface of the cylindrical cavity 22 is tangentially fitted with an earmuff 215 of the headphone, an inner part of the cylindrical cavity 22 is empty, and a material of an inner surface of the cylindrical cavity 22 is sound-absorbing cotton.

It is clear to those skilled in the art that for the convenience and simplicity of the description, a specific working process of the above-mentioned device may refer to a corresponding process in the aforementioned method embodiment and will not be repeated herein.

Embodiment Three

Figure 3:
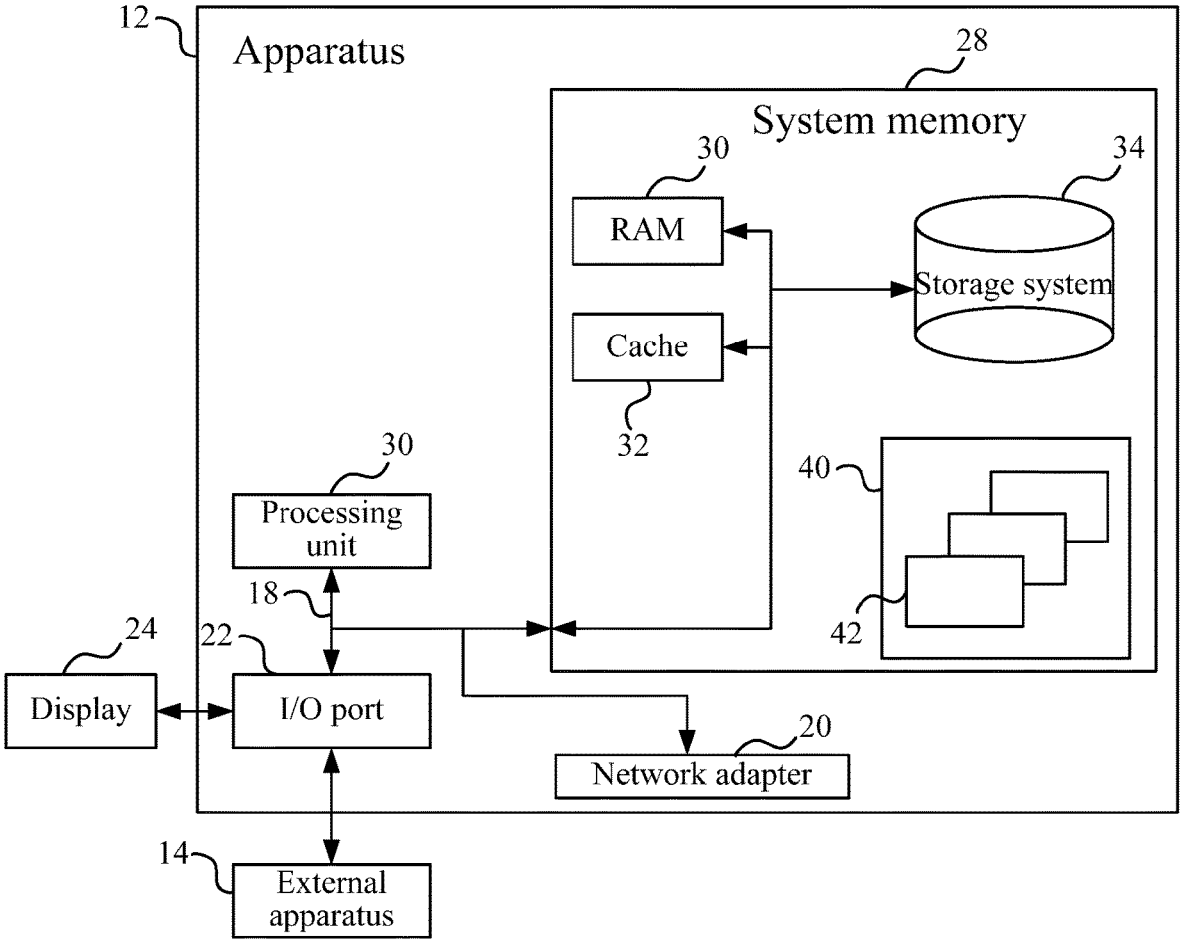
FIG. 3 is a structural diagram of an apparatus according to embodiment three of the present disclosure.

FIG. 3 is a structural diagram of an apparatus according to embodiment three of the present disclosure. FIG. 3 is a structural diagram of an exemplary apparatus suitable for implementing embodiments of the present disclosure. The device 12 shown in FIG. 3 is merely an example and is not intended to limit the function and use scope of the embodiments of the present disclosure.

As shown in FIG. 3, the device 12 is represented in a form of a general purpose computing apparatus. Components of the apparatus 12 may include, but is not limited to, one or more processors or processing units 16, a system memory 28, and a bus 18 connecting different system components (including the system memory 28 and the processing unit 16).

The bus 18 represents one or more of several types of bus structures including a memory bus or a memory controller, a peripheral bus, a graphics acceleration port, a processor or a local bus using any one of multiple bus structures. For example, these architectures include, but are not limited to, an industry standard architecture (ISA) bus, a micro channel architecture (MCA) bus, an enhanced ISA bus, a video electronics standards association (VESA) local bus and a peripheral component interconnect (PCI) bus.

The apparatus 12 typically includes multiple computer system readable media. These media may be any available media that can be accessed by the apparatus 12. The media include volatile and non-volatile media, and removable and non-removable media.

The system memory 28 may include a computer system readable medium in the form of a volatile memory, such as a random access memory (RAM) 30 and/or a cache memory 32. The apparatus 12 may further include other removable/non-removable and volatile/non-volatile computer system storage media. Just for example, a storage system 34 may be configured to read and write a non-removable and non-volatile magnetic medium (not shown in FIG. 3 and generally referred to as a "hard disk drive"). Although not shown in FIG. 3, a magnetic disk drive used for reading and writing a removable non-volatile magnetic disk (for example, a "floppy disk") and an optical disk driver for reading and writing a removable non-volatile optical disk (such as a compact disc read-only memory (CD-ROM), a digital video disc-read only memory (DVD-ROM) or other optical media) may be provided. In these cases, each driver may be connected to the bus 18 via one or more data media interfaces. The system memory 28 may include at least one program product having a group of program modules (for example, at least one program module). These program modules are configured to perform functions of various embodiments of the present disclosure.

A program/utility 40 having a group of program modules 42 (at least one program module 42) may be stored in the system memory 28 or the like. Such program modules 42 include, but are not limited to, an operating system, one or more application programs, other program modules and program data. Each or some combination of these examples may include implementation of a network environment. The program module 42 generally performs functions and/or methods in embodiments described in the embodiments of the present disclosure.

The apparatus 12 may also communicate with one or more external apparatuses 14 (such as a keyboard, a pointing apparatus, a display 24 and the like), and may also communicate with one or more apparatuses that enable a user to interact with the apparatus 12, and/or any apparatus that enables the apparatus 12 to communicate with one or more other computing apparatuses (such as a network card, a modem and the like). These communications may be performed through an input/output (I/O) port 22. Moreover, the apparatus 12 may also communicate with one or more networks (such as a local area network (LAN), a wide area network (WAN) and/or a public network, for example, the Internet) through a network adapter 20. As shown in FIG. 3, the network adapter 20 communicates with other modules of the apparatus 12 via the bus 18. It should be understood that although not shown in FIG. 3, other hardware and/or software modules may be used in conjunction with the apparatus 12. The other hardware and/or software modules include, but are not limited to, microcode, an apparatus driver, a redundant processing unit, an external disk drive array, a redundant arrays of independent disks (RAID) system, a tape driver, a data backup storage system and the like.

The processing unit 16 executes various functional applications and data processing by operating the program stored in the system memory 28, for example, to implement an audio calibration method provided by the embodiment of the present disclosure. The method includes the steps described below.

An audio calibration signal is transmitted to the first loudspeaker and the second loudspeaker such that the first loudspeaker and the second loudspeaker generate sound signals.

First loudspeaker sound information is determined through a sound signal generated by the first loudspeaker and acquired by the first microphone and a sound signal generated by the first loudspeaker and acquired by the second microphone.

Second loudspeaker sound information is determined through a sound signal generated by the second loudspeaker and acquired by the first microphone and a sound signal generated by the second loudspeaker and acquired by the second microphone.

A calibration parameter of the first loudspeaker or a calibration parameter of the second loudspeaker is determined according to the first loudspeaker sound information and the second loudspeaker sound information.

Embodiment Four

Embodiment four of the present disclosure further provides a computer-readable storage medium storing a computer program (or referred to as computer executable instructions). When the program is executed by the processor, the audio calibration method described in any one of the above-mentioned embodiments may be implemented. The method includes steps described below.

An audio calibration signal is transmitted to a first loudspeaker and a second loudspeaker such that the first loudspeaker and the second loudspeaker generate sound signals.

First loudspeaker sound information is determined through a sound signal generated by the first loudspeaker and acquired by a first microphone and a sound signal generated by the first loudspeaker and acquired by a second microphone.

Second loudspeaker sound information is determined through a sound signal generated by the second loudspeaker and acquired by the first microphone and a sound signal generated by the second loudspeaker and acquired by the second microphone.

A calibration parameter of the first loudspeaker or a calibration parameter of the second loudspeaker is determined according to the first loudspeaker sound information and the second loudspeaker sound information.

The computer storage medium of this embodiment of the present disclosure may employ any combination of one or more computer-readable media. The computer-readable medium may be a computer-readable signal medium or a computer-readable storage medium. The computer-readable storage medium may be, but is not limited to, an electrical, magnetic, optical, electromagnetic, infrared or semiconductor system, device or component, or any combination thereof. More specific examples of the computer-readable storage medium include (non-exhaustive list): an electrical connection having one or more wires, a portable computer magnetic disk, a hard disk, a random access memory (RAM), a read only memory (ROM), an erasable programmable read only memory (EPROM or flash memory), an optical fiber, a portable compact disk read only memory (CD-ROM), an optical memory device, a magnetic memory device, or any suitable combination thereof. In this document, the computer-readable storage medium may be any tangible medium containing or storing a program. The program may be used by or used in conjunction with an instruction execution system, device or component.

The computer-readable signal medium may include a data signal propagated on a base band or as a part of a carrier wave. The data signal carries computer-readable program codes. Such propagated data signals may take multiple forms including, but not limited to, electromagnetic signals, optical signals, or any suitable combination thereof. The computer-readable signal medium may also be any computer-readable medium other than a computer-readable storage medium. The computer-readable medium may send, propagate or transmit the program used by or used in conjunction with the instruction execution system, device or component.

Program codes contained in the computer-readable medium may be transmitted via any suitable medium. The medium includes, but is not limited to, the wireless, the wire, the optical cable, the radio frequency (RF) or the like, or any suitable combination thereof.

Computer program codes for performing the operations of embodiments of the present disclosure may be written in one or more programming languages or combination thereof. The programming languages include object-oriented programming languages such as Java, Smalltalk, C++, as well as conventional procedural programming languages such as "C" language or similar programming languages. The program codes may be entirely executed on a user computer, partially executed on the user computer, executed as an independent software package, partially executed on the user computer and partially executed on a remote computer, or entirely executed on the remote computer or a server. In a case related to the remote computer, the remote computer may be connected to the user computer via any kind of network including a local area network (LAN) or a wide area network (WAN), or may be connected to an external computer (for example, be connected via the Internet by using an Internet service provider).

It should be noted that the above are merely preferred embodiments of the present disclosure and the technical principles used therein. It is to be understood by those skilled in the art that the present disclosure is not limited to the specific embodiments described herein. Those skilled in the art can make various apparent modifications, adaptations and substitutions without departing from the scope of the present disclosure. Therefore, while the present disclosure has been described in detail through the preceding embodiments, the present disclosure is not limited to the preceding embodiments and may include more other equivalent embodiments without departing from the concept of the present disclosure. The scope of the present disclosure is determined by the scope of the appended claims.

What is claimed is:

1. An audio calibration method, executed by a processor built in a headphone which comprises a first loudspeaker, a second loudspeaker, a first microphone and a second microphone, and the audio calibration method comprising:

transmitting an audio calibration signal to the first loudspeaker and the second loudspeaker such that the first loudspeaker and the second loudspeaker generate sound signals, wherein the first loudspeaker and the second loudspeaker are disposed opposite to each other;

determining first loudspeaker sound information through a sound signal generated by the first loudspeaker and acquired by the first microphone and a sound signal generated by the first loudspeaker and acquired by the second microphone, wherein the first microphone and the second microphone are disposed opposite to each other;

determining second loudspeaker sound information through a sound signal generated by the second loudspeaker and acquired by the first microphone and a sound signal generated by the second loudspeaker and acquired by the second microphone; and determining a calibration parameter of the first loudspeaker or a calibration parameter of the second loudspeaker according to the first loudspeaker sound information and the second loudspeaker sound information;

wherein determining the calibration parameter of the first loudspeaker or the calibration parameter of the second loudspeaker according to the first loudspeaker sound information and the second loudspeaker sound information comprises:

if a difference value between a sensitivity of the first loudspeaker sound information and a sensitivity of the second loudspeaker sound information is within a preset range, calculating a difference value between the first loudspeaker sound information and the second loudspeaker sound information; and taking the difference value between the first loudspeaker sound information and the second loudspeaker sound information as the calibration parameter of the first loudspeaker or the calibration parameter of the second loudspeaker.

2. The audio calibration method of claim 1, wherein the first loudspeaker sound information is an average value of the sound signal generated by the first loudspeaker and acquired by the first microphone and the sound signal generated by the first loudspeaker and acquired by the second microphone.

3. The audio calibration method of claim 1, wherein the second loudspeaker sound information is an average value of the sound signal generated by the second loudspeaker and acquired by the first microphone and the sound signal generated by the second loudspeaker and acquired by the second microphone.

4. The audio calibration method of claim 1, wherein taking the difference value between the first loudspeaker sound information and the second loudspeaker sound information as the calibration parameter of the first loudspeaker or the calibration parameter of the second loudspeaker comprises:

if the difference value between the sensitivity of the first loudspeaker sound information and the sensitivity of the second loudspeaker sound information is greater than zero, taking the difference value between the first loudspeaker sound information and the second loudspeaker sound information as the calibration parameter of the first loudspeaker; and if the difference value between the sensitivity of the first loudspeaker sound information and the sensitivity of the second loudspeaker sound information is less than zero, taking the difference value between the first loudspeaker sound information and the second loudspeaker sound information as the calibration parameter of the second loudspeaker.

5. The audio calibration method of claim 4, wherein if the difference value between the sensitivity of the first loudspeaker sound information and the sensitivity of the second loudspeaker sound information is greater than zero, the difference value between the first loudspeaker sound information and the second loudspeaker sound information is inversely converted to a negative value and the negative value is superimposed on the first loudspeaker sound information.

6. The audio calibration method of claim 4, wherein if the difference value between the sensitivity of the first loudspeaker sound information and the sensitivity of the second loudspeaker sound information is less than zero, the difference value between the first loudspeaker sound information and the second loudspeaker sound information is superimposed on the second loudspeaker sound information.

7. An audio calibration device, applied to calibrate consistency of a first loudspeaker and a second loudspeaker in a headphone by using an audio calibration method;

wherein the audio calibration method is executed by a processor built in the headphone which comprises the first loudspeaker, the second loudspeaker, a first microphone and a second microphone, and the audio calibration method comprises:

transmitting an audio calibration signal to the first loudspeaker and the second loudspeaker such that the first loudspeaker and the second loudspeaker generate sound signals, wherein the first loudspeaker and the second loudspeaker are disposed opposite to each other;

determining first loudspeaker sound information through a sound signal generated by the first loudspeaker and acquired by the first microphone and a sound signal generated by the first loudspeaker and acquired by the second microphone, wherein the first microphone and the second microphone are disposed opposite to each other;

determining second loudspeaker sound information through a sound signal generated by the second loudspeaker and acquired by the first microphone and a sound signal generated by the second loudspeaker and acquired by the second microphone; and determining a calibration parameter of the first loudspeaker or a calibration parameter of the second loudspeaker according to the first loudspeaker sound information and the second loudspeaker sound information, wherein determining the calibration parameter of the first loudspeaker or the calibration parameter of the second loudspeaker according to the first loudspeaker sound information and the second loudspeaker sound information comprises:

if a difference value between a sensitivity of the first loudspeaker sound information and a sensitivity of the second loudspeaker sound information is within a preset range, calculating a difference value between the first loudspeaker sound information and the second loudspeaker sound information; and taking the difference value between the first loudspeaker sound information and the second loudspeaker sound information as the calibration parameter of the first loudspeaker or the calibration parameter of the second loudspeaker.

8. The audio calibration device of claim 7, wherein the first loudspeaker sound information is an average value of the sound signal generated by the first loudspeaker and acquired by the first microphone and the sound signal generated by the first loudspeaker and acquired by the second microphone.

9. The audio calibration device of claim 7, wherein the second loudspeaker sound information is an average value of the sound signal generated by the second loudspeaker and acquired by the first microphone and the sound signal generated by the second loudspeaker and acquired by the second microphone.

10. The audio calibration method of claim 7, wherein taking the difference value between the first loudspeaker sound information and the second loudspeaker sound information as the calibration parameter of the first loudspeaker or the calibration parameter of the second loudspeaker comprises:

if the difference value between the sensitivity of the first loudspeaker sound information and the sensitivity of the second loudspeaker sound information is greater than zero, taking the difference value between the first loudspeaker sound information and the second loudspeaker sound information as the calibration parameter of the first loudspeaker; and if the difference value between the sensitivity of the first loudspeaker sound information and the sensitivity of the second loudspeaker sound information is less than zero, taking the difference value between the first loudspeaker sound information and the second loudspeaker sound information as the calibration parameter of the second loudspeaker.

11. The audio calibration method of claim 10, wherein if the difference value between the sensitivity of the first loudspeaker sound information and the sensitivity of the second loudspeaker sound information is greater than zero, the difference value between the first loudspeaker sound information and the second loudspeaker sound information is inversely converted to a negative value and the negative value is superimposed on the first loudspeaker sound information.

12. The audio calibration method of claim 10, wherein if the difference value between the sensitivity of the first loudspeaker sound information and the sensitivity of the second loudspeaker sound information is less than zero, the difference value between the first loudspeaker sound information and the second loudspeaker sound information is superimposed on the second loudspeaker sound information.

* * * * *